US010280711B2

(12) United States Patent
Craik

(10) Patent No.: US 10,280,711 B2
(45) Date of Patent: May 7, 2019

(54) SYSTEM AND METHOD FOR ACTUATING ISOLATION VALVES IN A SUBTERRANEAN WELL

(71) Applicant: HALLIBURTON ENERGY SERVICES, INC., Houston, TX (US)

(72) Inventor: Steven J. Craik, Arbroath (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/398,152

(22) PCT Filed: Oct. 2, 2012

(86) PCT No.: PCT/US2012/058385

§ 371 (c)(1),
(2) Date: Oct. 31, 2014

(87) PCT Pub. No.: WO2014/055063

PCT Pub. Date: Apr. 10, 2014

(65) Prior Publication Data

US 2015/0122506 A1 May 7, 2015

(51) Int. Cl.
*E21B 34/10* (2006.01)
*E21B 34/14* (2006.01)
(Continued)

(52) U.S. Cl.
CPC ..... *E21B 34/14* (2013.01); *E21B 34/12* (2013.01); *E21B 34/16* (2013.01)

(58) Field of Classification Search
CPC combination set(s) only.
See application file for complete search history.

(56) References Cited

U.S. PATENT DOCUMENTS 3,856,082 A * 12/1974 Dinning ..... E21B 34/14 166/154
5,810,087 A * 9/1998 Patel ..... 166/373
(Continued)

FOREIGN PATENT DOCUMENTS

WO WO-2012/112657 8/2012

OTHER PUBLICATIONS

Search Report and Written Opinion dated Apr. 16, 2013 for International Application PCT/US12/58385, 9 pages.
(Continued)

*Primary Examiner* — David J Bagnell
*Assistant Examiner* — Ronald R Runyan
(74) *Attorney, Agent, or Firm* — Locke Lord LLP; Daniel J. Fiorello; Daniel G. Nguyen

(57) ABSTRACT

A method of actuating one or more isolation valves in a well can include conveying a tubular string into the well, the tubular string including a shifting tool, inserting the shifting tool into an isolation valve, thereby opening the isolation valve, and withdrawing the shifting tool from the isolation valve, the isolation valve remaining open after the withdrawing. A completion system for use in a well can include multiple isolation valves, and a shifting tool which opens one isolation valve, allowing full bore inner diameter and not restricting flow, and closes another isolation valve. A shifting tool for actuating multiple isolation valves in a well can include multiple shifting profiles, whereby one shifting profile opens an isolation valve, and another shifting profile closes another isolation valve.

7 Claims, 6 Drawing Sheets

(51) Int. Cl.
*E21B 34/16* (2006.01)
*E21B 34/12* (2006.01)

(56) References Cited

U.S. PATENT DOCUMENTS

| | | | | |
|---|---|---|---|---|
| 5,921,318 | A * | 7/1999 | Ross | E21B 33/124 166/126 |
| 6,227,298 | B1 * | 5/2001 | Patel | 166/321 |
| 6,631,768 | B2 * | 10/2003 | Patel et al. | 166/373 |
| 7,347,272 | B2 * | 3/2008 | Patel et al. | 166/373 |
| 2001/0030049 | A1 | 10/2001 | Patel | |
| 2002/0066573 | A1 | 6/2002 | Patel | |
| 2003/0150622 | A1 | 8/2003 | Patel et al. | |
| 2004/0238173 | A1 * | 12/2004 | Bissonnette | E21B 34/14 166/307 |
| 2009/0260835 | A1 | 10/2009 | Malone | |
| 2009/0266556 | A1 * | 10/2009 | Swenson | E21B 34/14 166/373 |
| 2011/0005772 | A1 | 1/2011 | Ceccarelli et al. | |

OTHER PUBLICATIONS

Statoil Brazil Peregrino Project, Horizontal Open Hole Gravel Pack, Assembly and results chart, dated Apr. 26, 2011, 1 page.

Statoil Brazil Peregrino Project, MiddleCompletion, Assembly and results chart, dated May 5, 2011, 1 page.

Statoil Brazil Peregrino Project, UpperCompletion Interface, Assembly and results chart, dated May 9, 2011, 1 page.

Statoil Peregrino Producers, Assembly chart, dated May 2, 2011, 1 page.

Halliburton Completion Tools, H06472, IB Series Mechanical Fluid Loss Isolation Barrier Valve product brochure, dated Sep. 2010, 2 pages.

Shell Brazil Block BC-10 Project, Horizontal Gravel Pack Completion Schematic, Well P2H, dated Sep. 30, 2008, 1 page.

Shell Brazil Block BC-10 Project, Horizontal Gravel Pack Completion Schematic, Ostra P2H, dated Sep. 28, 2008, 1 page.

Shell Ostra P2H, Upper Completion Schematic, dated Oct. 10, 2008, 1 page.

Schlumberger Isolation Valves product brochure 09-CO-0133, dated 2009, 8 pages.

Halliburton H06327, Sand Control Multi-Position Gravel Pack System product brochure, dated May 2008, 2 pages.

Combined Search and Examination Report dated Mar. 8, 2016, issued during the prosecution of corresponding United Kingdom Patent Application No. GB1514948.7 (5 pages).

* cited by examiner

PRIOR ART

PRIOR ART

SYSTEM AND METHOD FOR ACTUATING ISOLATION VALVES IN A SUBTERRANEAN WELL

TECHNICAL FIELD

This disclosure relates generally to equipment utilized and operations performed in conjunction with a subterranean well and, in one example described below, more particularly provides a unique way of actuating isolation valves.

BACKGROUND

An isolation valve is used to isolate a formation penetrated by a wellbore from fluids and pressures in the wellbore above the isolation valve (or nearer the earth's surface). In some circumstances, it is desirable to install one isolation valve above another isolation valve.

If a lower isolation valve is mechanically operated by means of a shifting tool, the lower isolation valve can have the shifting tool remaining therein (for example, to open the valve) after the upper isolation valve has been installed (along with a packer, other completion equipment, etc.). The shifting tool left in the lower isolation valve can restrict flow through the valve. The lower isolation valve could be below a mechanically, remotely or otherwise operable isolation valve.

Therefore, it will be appreciated that improvements are continually needed in the arts of constructing isolation valves and actuating isolation valves in a well.

SUMMARY

In this disclosure, a system and a method are provided which bring improvements to the art. An example is described below in which an isolation valve is opened by use of a shifting tool. The shifting tool can be subsequently withdrawn from the isolation valve, with the isolation valve remaining open.

A method of actuating multiple isolation valves in a well is provided to the art by the disclosure below. In one example, the method can comprise: conveying a tubular string into the well, the tubular string including a shifting tool; inserting the shifting tool into an isolation valve, thereby opening the isolation valve; and withdrawing the shifting tool from the isolation valve, the isolation valve remaining open after the withdrawing.

A completion system for use in a well is also provided below. In one example, the system can include multiple isolation valves, and a shifting tool which opens one isolation valve and closes another isolation valve.

Also described below is a shifting tool for actuating multiple isolation valves in a well. The shifting tool can include multiple shifting profiles, whereby one shifting profile opens a first isolation valve, and another shifting profile closes a second isolation valve.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
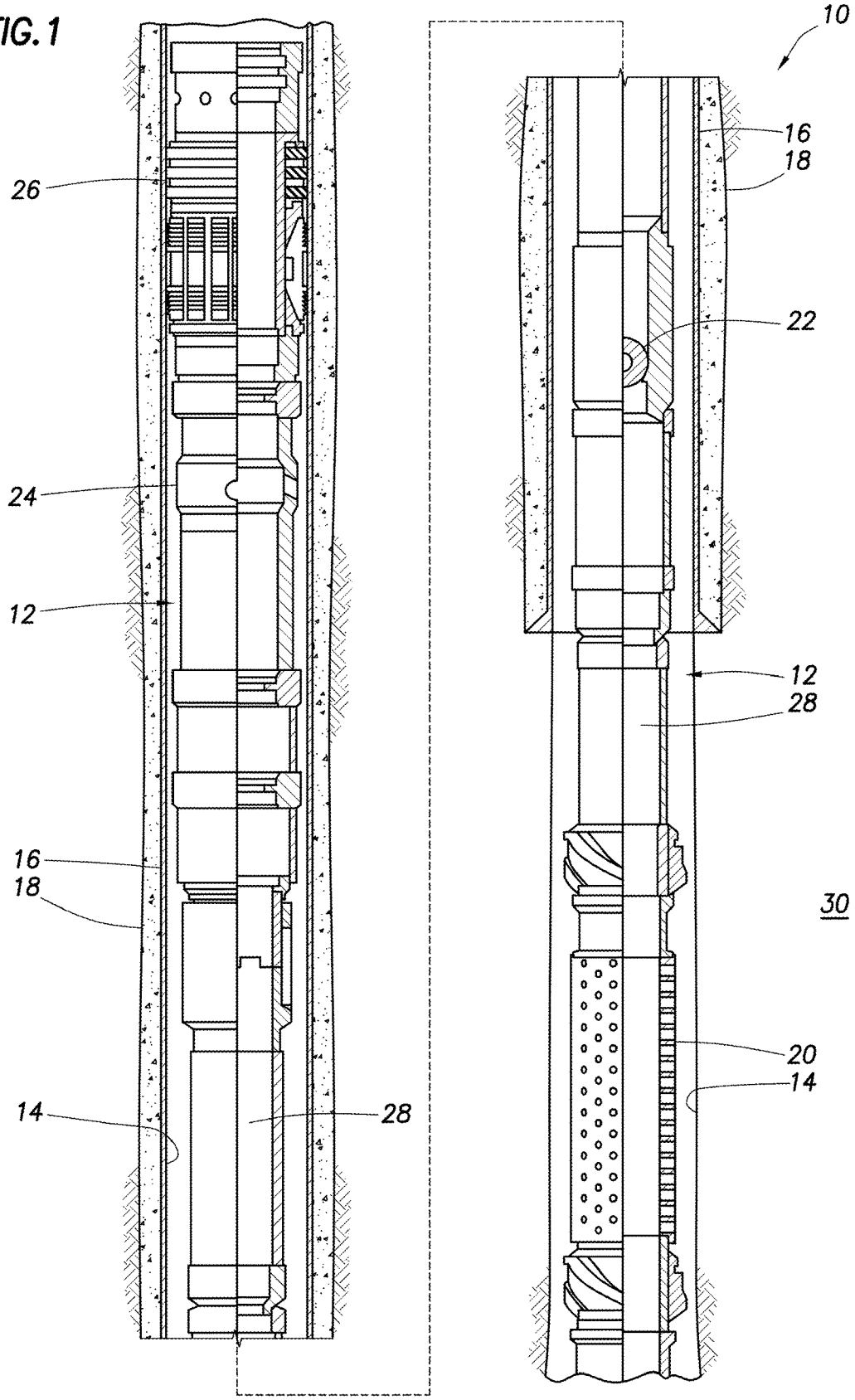
FIG. 1 is a representative partially cross-sectional view of a well completion system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a generally tubular completion string 12 has been installed in a wellbore 14. Although the wellbore 14 is depicted in FIG. 1 as being generally vertical, and as being partially cased (e.g., with casing 16 and cement 18), in other examples the wellbore could be completely lined with casing or liner, uncased or open hole, the wellbore could be horizontal or inclined relative to vertical, or otherwise configured.

The completion string 12 in this example includes a set of well screens 20 (only one of which is visible in FIG. 1), an isolation valve 22, a sliding sleeve-type valve 24 (such as a closing sleeve of the type utilized in gravel packing), and a packer 26. The completion string 12 could in other examples include more or less components, different components, or another combination of components. Gravel packing, stimulation, fracturing or any other particular operation is not necessary in keeping with the scope of this disclosure.

The isolation valve 22 is depicted in FIG. 1 as being closed, thereby preventing fluid flow through an internal flow passage 28 which extends longitudinally in the completion string 12. The flow passage 28 below the isolation valve 22 is in communication (via the well screens 20) with an earth formation 30 penetrated by the wellbore 14, and so the closing of the isolation valve 22 prevents fluids and pressures above the isolation valve from communicating with the formation 30.

It is desired, in this example, to install another packer and isolation valve above the packer 26 and isolation valve 22 shown in FIG. 1. There may be various reasons for doing so, but one circumstance which could prompt installation of another packer and isolation valve is that a leak could develop in the casing 16 above the packer 26. However, it should be clearly understood that it is not necessary, in keeping with the scope of this disclosure, for there to be a leak in the casing 16.

Figure 2:
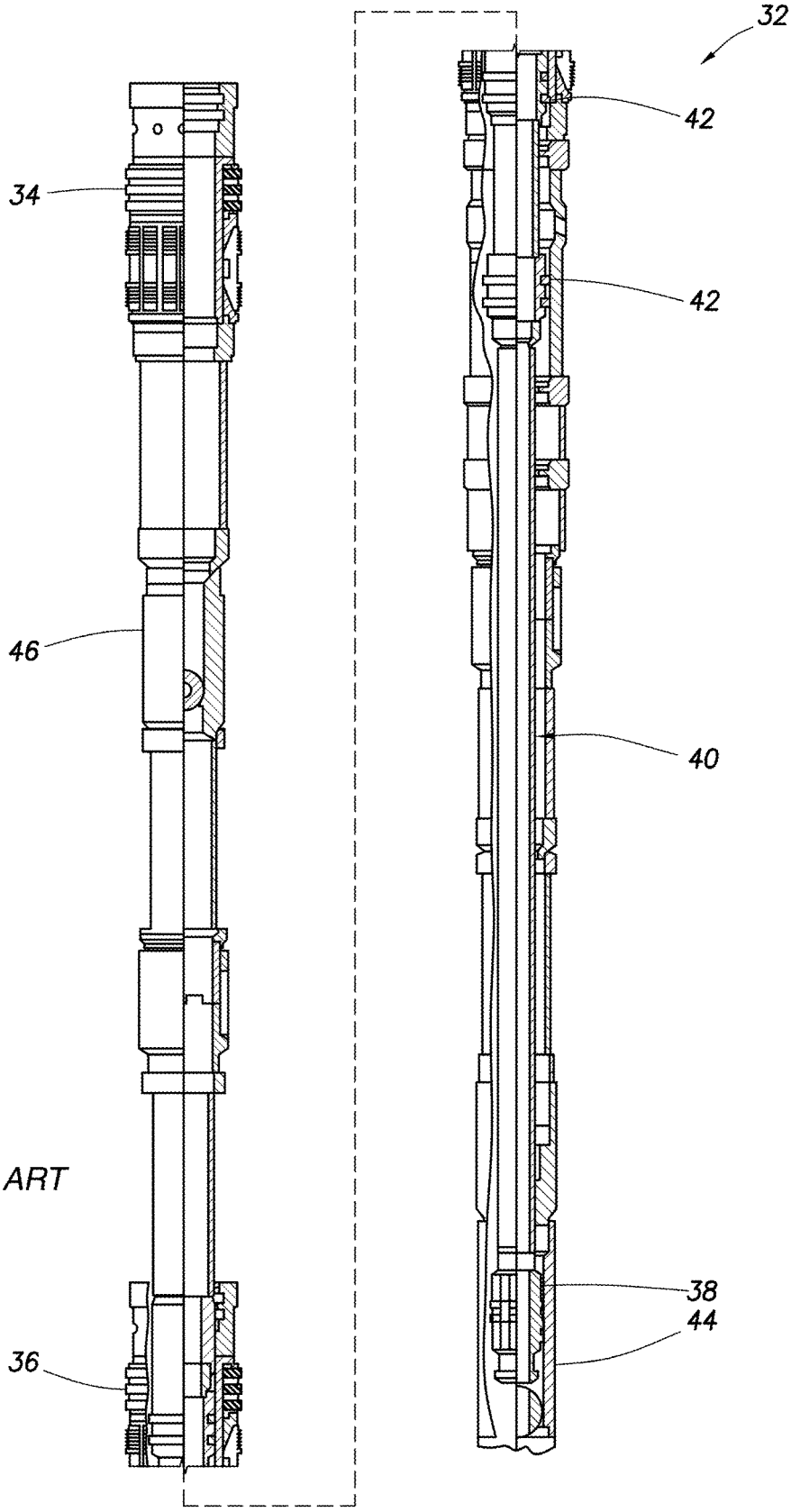
FIG. 2 is a representative partially cross-sectional view of a prior art technique of actuating multiple isolation valves.

Referring additionally now to FIG. 2, a prior art technique 32 for installing one packer 34 above another packer 36 in a similar completion system is representatively illustrated. In this technique, a shifting tool 38 is carried on a washpipe 40 which extends downwardly from the lower packer 36.

The washpipe 40 is inserted into the previously installed lower packer 36, so that seals 42 are received in one or more seal bores (e.g., in the packer 36, below a closing sleeve, etc.), and the shifting tool 38 engages an isolation valve 44 below the packer 36 to open the isolation valve. Another isolation valve 46 is connected below the upper packer 34, so that opening of the lower isolation valve 44 does not result in a formation being placed in communication with fluids and pressures above the isolation valve 46.

The upper packer 34 is then set, and the upper isolation valve 46 can be opened when desired (for example, using a separate mechanical shifting tool, by application of a certain number or pattern of pressures, etc.). This technique 32 results in isolation of a section of casing between the packers 34, 36, but note that the shifting tool 38 remains in the lower isolation valve 44.

Unfortunately, the presence of the shifting tool 38 in the isolation valve 44 will likely restrict flow of fluid through the isolation valve, and this flow restriction may be unacceptable, at least in that it will reduce production of fluids from the well, and it will restrict access to the completion string below the isolation valve. As described more fully below, the system 10 and method do not result in restricting flow or access through a lower isolation valve and, thus, the system 10 and method represent a significant improvement over the prior art technique 32 of FIG. 2.

Figure 3:
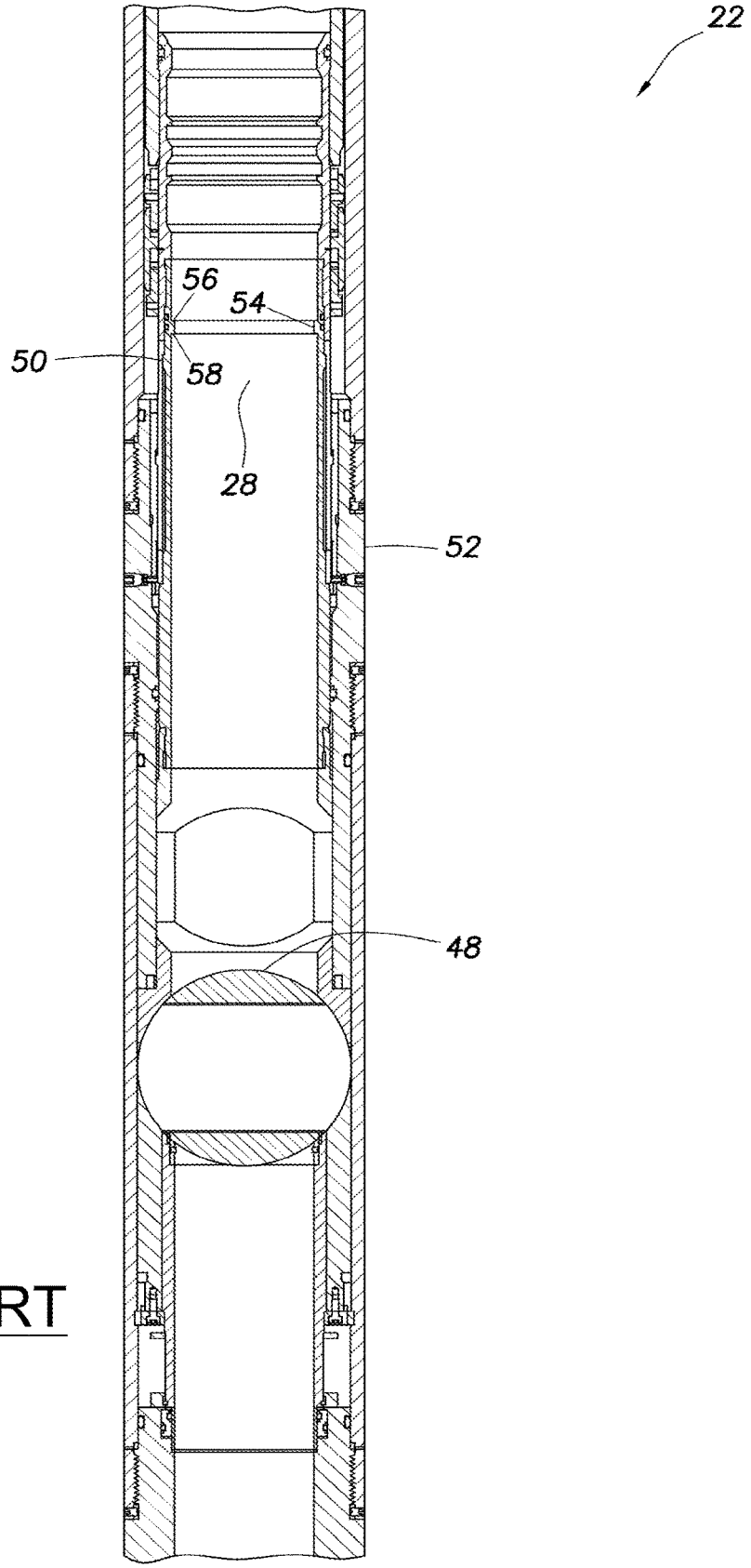
FIG. 3 is a representative cross-sectional view of one example of an isolation valve which may be used in the system and method of FIG. 1.

Referring additionally now to FIG. 3, an example of one type of isolation valve 22 which may be used in the system 10 and method is representatively illustrated. In this view, it may be seen that the isolation valve 22 includes a ball 48 that is rotated, in order to permit or prevent flow through the passage 28 extending longitudinally through the valve. However, other types of valves may be used, without departing from the scope of this disclosure.

The isolation valve 22 as depicted in FIG. 3 is the same as, or is similar to, a commercially available IB4™ isolation valve marketed by Halliburton Energy Services, Inc. of Houston, Tex. USA, but other isolation valves (such as, an IB5™ or FS2™ isolation valve marketed by Halliburton Energy Services, etc.) may be used, if desired. The scope of this disclosure is not limited to use of any particular isolation valve, or to any particular type of isolation valve.

An inner generally tubular mandrel 50 of the isolation valve 22 can be reciprocably displaced relative to an outer housing 52, in order to cause rotation of the ball 48. In this example, the mandrel 50 is displaced downward to cause the ball 48 to rotate to its open position, thereby allowing fluid flow through the passage 28.

An internal shifting profile 54 is formed in the mandrel 50. This profile 54 can be engaged by a suitably configured external profile on a shifting tool, so that a downward force can be applied to the mandrel 50 by the shifting tool.

In the FIG. 3 example, the shifting profile 54 includes both upwardly and downwardly facing shoulders 56, 58, to allow effective application of respective downwardly and upwardly directed forces to the mandrel 50 from the external profile on the shifting tool. Thus, the isolation valve 22 can be both opened and closed by use of the shifting tool.

In conventional operations, the external shifting profile on the shifting tool would include both downwardly and upwardly facing shoulders which engage the respective upwardly and downwardly facing shoulders 56, 58 of the shifting profile 54. In this manner, after the external shifting profile has appropriately engaged the internal shifting profile 54, the shifting tool can be displaced downward to rotate the ball 48 to its open position, and can be displaced upward to rotate the ball to its closed position.

However, in the system 10 and method of FIG. 1, it is desired to open the lower isolation valve 22, and then to withdraw the shifting tool from the isolation valve (so that the shifting tool does not remain in the isolation valve to restrict flow and access), without reclosing the isolation valve. An example of a shifting tool 60 having this capability (and others) is representatively illustrated in FIG. 4.

Figure 4:
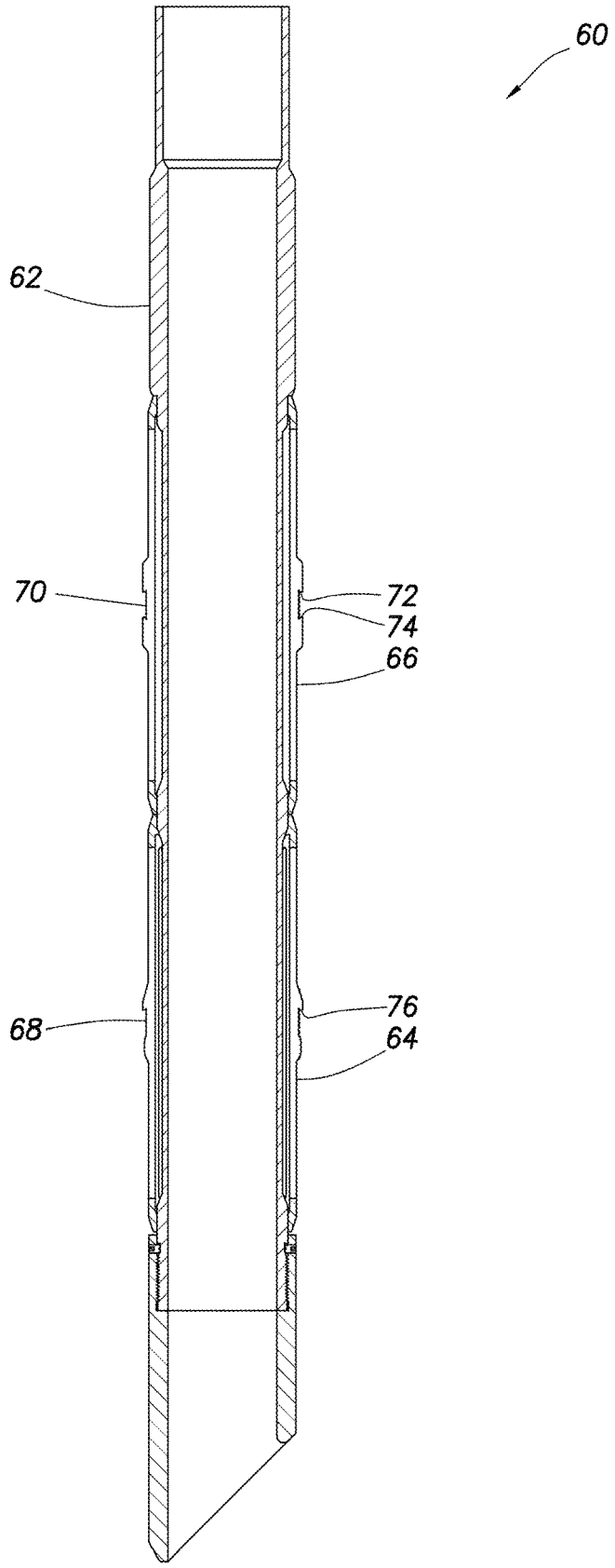
FIG. 4 is a representative cross-sectional view of a shifting tool which can embody principles of this disclosure.

The shifting tool 60 depicted in FIG. 4 includes a generally tubular mandrel 62 having two sets of longitudinally elongated resilient collets 64, 66 carried thereon. Each set of collets 64, 66 has a respective shifting profile 68, 70 formed externally thereon.

The external shifting profiles 68, 70 are both configured to complementarily engage the internal shifting profile 54 in an isolation valve. However, the shifting profiles 68, 70 are not identical.

Instead, the upper shifting profile 70 is provided with both downwardly and upwardly facing shoulders 72, 74 for engaging the respective upwardly and downwardly facing shoulders 56, 58 of the internal shifting profile 54, whereas the lower shifting profile 68 is provided only with a downwardly facing shoulder 76 for engaging the upwardly facing shoulder 56 of the internal shifting profile.

Thus, when the lower set of collets 64 is inserted into the isolation valve 22, the lower shifting profile 68 can engage the internal shifting profile 54 in the isolation valve, and the mandrel 50 can thereby be displaced downward to rotate the ball to its open position, but if the shifting profile 68 is subsequently withdrawn upwardly from the isolation valve, the mandrel will not thereby be displaced upward to close the valve.

The upper external shifting profile 70 is provided on the shifting tool 60, in order to allow an upper isolation valve to be opened and closed as desired. For this purpose, the shifting profile 70 is provided with the downwardly and upwardly facing shoulders 72, 74. However, if it is desired to only close an upper isolation valve, only the upwardly facing shoulder 74 may be provided on the shifting profile 70.

Figure 5:
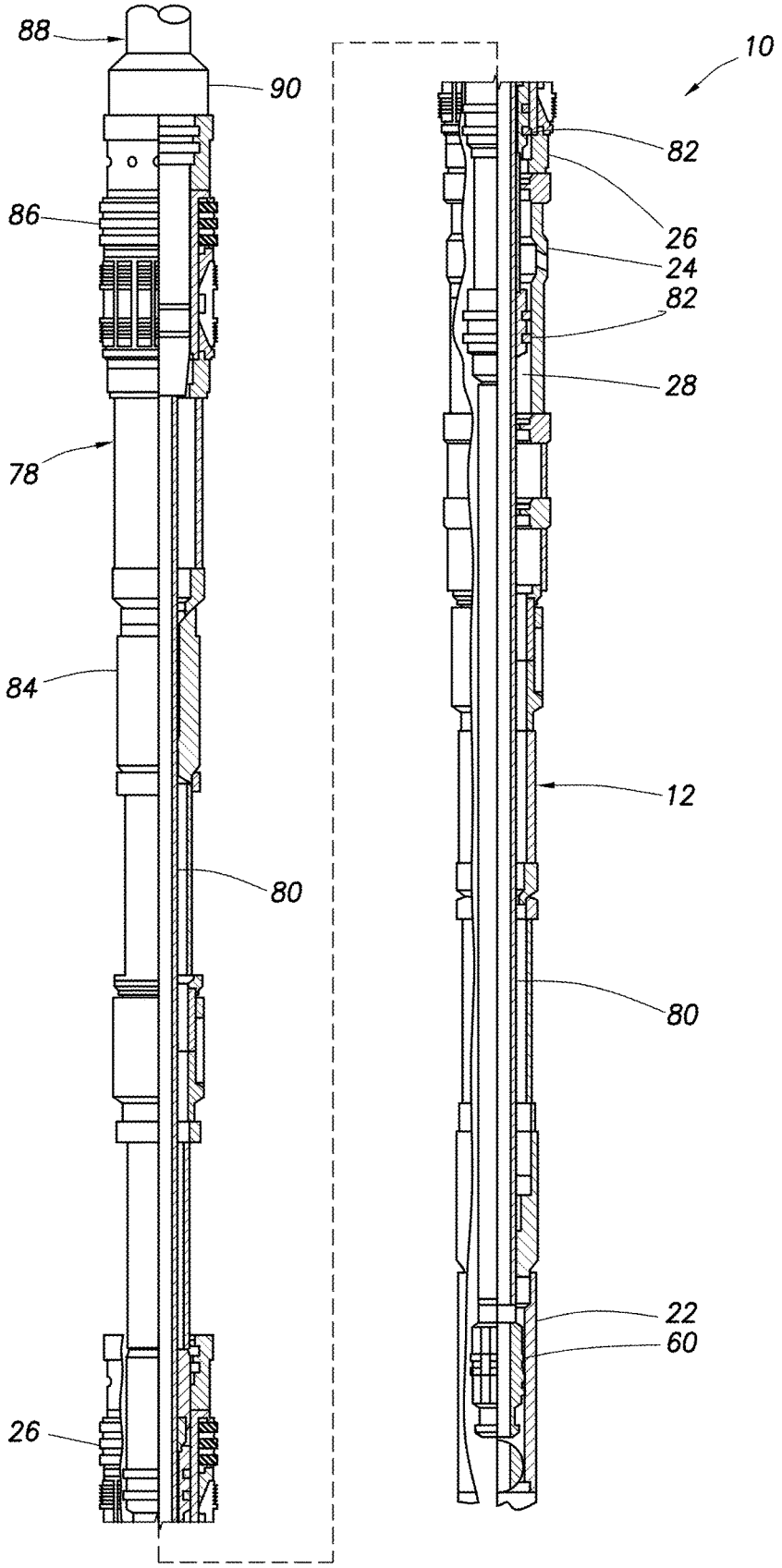
FIG. 5 is a representative partially cross-sectional view of the FIG. 1 system and method, in which a lower isolation valve is actuated by the FIG. 4 shifting tool.

Referring additionally now to FIG. 5, the system 10 and method are representatively illustrated after a generally tubular upper completion string 78 has been conveyed into the well and engaged with the lower completion string 12. The wellbore 14, casing 16 and cement 18 are not shown in FIG. 5 for clarity of illustration.

In this example, the upper completion string 78 includes seals 82 for sealing engagement with the lower completion string 12, an isolation valve 84, and a packer 86. The isolation valve 84 may be similar to, or the same as, the lower isolation valve 22.

The upper completion string 78 is conveyed into the well on a tubular string 88 of the type known to those skilled in the art as a "work string." The tubular string 88 includes the FIG. 4 shifting tool 60, a pipe 80 extending upwardly from the shifting tool, and a setting tool 90 for releasably supporting and setting the upper packer 86.

When the upper completion string 78 and the tubular string 88 are inserted into the lower completion string 12, the shifting tool 60 will eventually enter the lower isolation valve 22, and the lower external shifting profile 68 on the shifting tool will engage the internal shifting profile 54 in the isolation valve. Further downward displacement of the tubular string 88 will apply a downwardly directed force to the isolation valve mandrel 50 (due to engagement between the shoulders 56, 76), downwardly displacing the mandrel and thereby causing the isolation valve 22 to open. At this point, the seals 82 will be engaged in seal bores in the lower completion string 12, so opening of the isolation valve 22 will preferably cause the formation 30 to be exposed only to fluids and pressures in the tubular string 88 and in the lower completion string 78.

Note that the upper isolation valve 84 is open at this point, with the tubular string 88 (specifically, the pipe 80) extending through the upper isolation valve. The upper packer 86 is now set, thereby isolating a section of the casing 16 between the upper and lower packers 86, 26.

Figure 6:
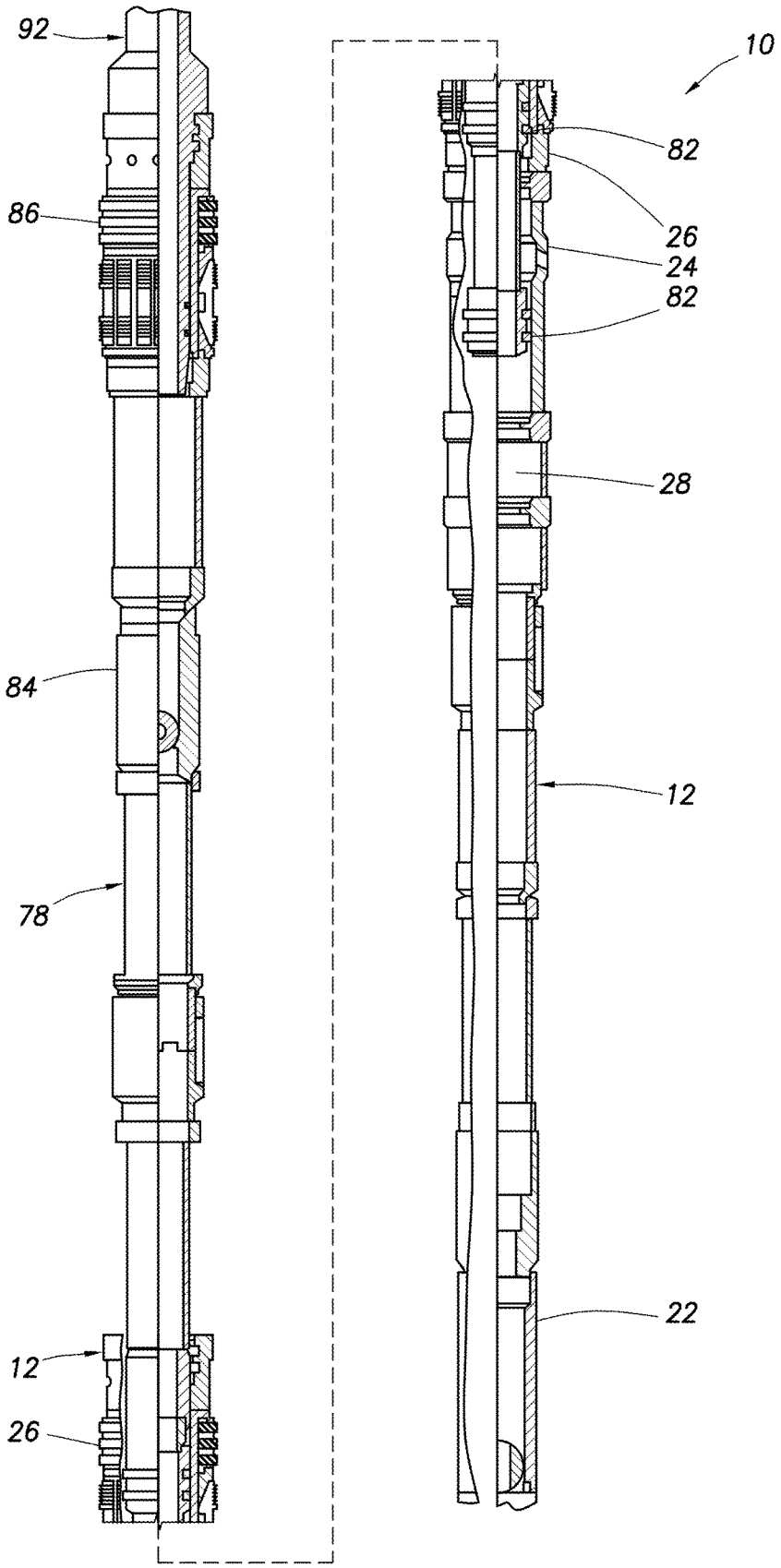
FIG. 6 is a representative partially cross-sectional view of the system and method, following withdrawal of the shifting tool.

Referring additionally now to FIG. 6, the system 10 and method are representatively illustrated after the tubular string 88 has been withdrawn from the lower and upper completion strings 12, 78 (and from the well). Note that the lower isolation valve 22 remains open, even though the shifting tool 60 was displaced upwardly from the isolation valve after engagement of the shifting profiles 54, 68. This is due to the lack of an upwardly facing shoulder on the shifting profile 68 for engagement with the downwardly facing shoulder 58 on the internal shifting profile 54.

The upper isolation valve 84 has been closed by the upward displacement of the shifting tool 60 through the isolation valve. As the shifting tool 60 displaces upwardly through the isolation valve 84, the external shifting profile 70 on the shifting tool engages the internal shifting profile 54 in the isolation valve, thereby applying an upwardly directed force to the mandrel 50 and displacing it upward, which rotates the ball 48 to its closed position.

The upper isolation valve 84 may subsequently be opened, for example, by use of a mechanical shifting tool conveyed into the upper completion, by application of a certain pattern or number of pressures to the isolation valve, etc. Preferably, another completion string 92 or production tubing, etc., is sealingly engaged with the completion string 78 prior to opening the upper isolation valve 84.

In this regard, note that use of the term "upper" to designate the completion string 78, isolation valve 84 and packer 86 does not require that these components are necessarily uppermost in the well. Instead, such terms ("upper," "lower," etc.) are used merely for convenience to describe relative positions of components in the illustrated example.

It may now be fully appreciated that the disclosure above provides significant advances to the arts of constructing completion systems and operating isolation valves in wells. It can be clearly seen in the FIG. 6 example that the shifting tool 60 does not remain in the lower isolation valve 22 and, thus, does not restrict flow or access through the isolation valve. In addition, the shifting tool 60 is operative to close the upper isolation valve 84 as the tubular string 88 is withdrawn from the completion string 78 (although it is not necessary for the shifting tool 60 to close the upper isolation valve, since another shifting tool or other device could be used to close the upper isolation valve, if desired).

A method of actuating one or more isolation valves 22, 84 in a subterranean well is described above. In one example, the method can comprise: conveying a tubular string 88 into the well, the tubular string 88 including a shifting tool 60; inserting the shifting tool 60 into a first isolation valve 22, thereby opening the first isolation valve 22; and withdrawing the shifting tool 60 from the first isolation valve 22, the first isolation valve 22 remaining open after the withdrawing step.

The withdrawing step can also include displacing the shifting tool 60 through a second isolation valve 84, thereby closing the second isolation valve 84. The conveying step can include conveying the second isolation valve 84 with the tubular string 88 into the well, the tubular string 88 extending through the second isolation valve 84.

The conveying step can include conveying a packer 86 with the tubular string 88 into the well. The method can include setting the packer 86 after the inserting step.

The shifting tool 60 may include multiple longitudinally spaced apart sets of resilient collets 64, 66. A first set of collets 64 can actuate the first isolation valve 22, and a second set of collets 66 can actuate a second isolation valve 84.

The withdrawing step is preferably performed after the inserting step. The withdrawing step may include withdrawing the tubular string 88 with the shifting tool 60 from the well.

A completion system 10 for use in a subterranean well is also provided above. In one example, the system 10 can include first and second isolation valves 22, 84, and a shifting tool 60 which opens the first isolation valve 22 and closes the second isolation valve 84.

The system 10 can also include a first packer 26 set in the well between the first and second isolation valves 22, 84. The system 10 may also include a second packer 86 set in the well, the second isolation valve 84 being positioned between the first and second packers 26, 86.

The shifting tool 60 may comprise multiple longitudinally spaced apart sets of resilient collets 64, 66. A first set of collets 64 on the shifting tool 60 can open the first isolation valve 22, and a second set of collets 66 on the shifting tool 60 can close the second isolation valve 84.

The system 10 can also include a tubular string 88 which conveys the shifting tool 60 into the well, the tubular string 88 including a setting tool 90 which sets a packer 86, and the shifting tool 60 being connected to the setting tool 90 by a pipe 80 which extends through the second isolation valve 84.

Withdrawal of the tubular string 88 from the packer 86 may cause the shifting tool 60 to close the second isolation valve 84. Insertion of the shifting tool 60 into the first isolation valve 22 can open the first isolation valve 22.

A shifting tool 60 for actuating first and second isolation valves 22, 84 in a subterranean well is also described above. In one example, the shifting tool 60 comprises first and second shifting profiles 68, 70, whereby the first shifting profile 68 opens the first isolation valve 22, and the second shifting profile 70 closes the second isolation valve 84.

The first and second shifting profiles 68, 70 are preferably longitudinally spaced apart on the shifting tool 60. The first and second shifting profiles 68, 70 may be formed on respective first and second sets of resilient collets 64, 66.

The second shifting profile 70 can be used to open the second isolation valve 84.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of actuating one or more isolation valves in a subterranean well, the method comprising:

conveying a tubular string into the well, the tubular string including a shifting tool and an upper isolation valve, the shifting tool extending through the upper isolation valve during the conveying, wherein the upper isolation valve is in an open position during the conveying;

inserting the shifting tool into a lower isolation valve, thereby opening the lower isolation valve; and withdrawing the shifting tool from the lower isolation valve, the lower isolation valve remaining open after the withdrawing.

2. The method of claim 1, wherein the withdrawing further comprises withdrawing the shifting tool from the upper isolation valve, thereby closing the upper isolation valve.

3. The method of claim 1, wherein the conveying further comprises conveying a packer with the tubular string into the well, and the method further comprising setting the packer after the inserting.

4. The method of claim 1, wherein the shifting tool includes multiple longitudinally spaced apart sets of resilient collets.

5. The method of claim 4, wherein a first set of collets actuates the upper isolation valve, and wherein a second set of collets actuates the lower isolation valve.

6. The method of claim 1, wherein the withdrawing is performed after the inserting.

7. The method of claim 1, wherein the withdrawing further comprises withdrawing the shifting tool from the well.

* * * * *